United States Patent [19]

Tatchyn et al.

[11] Patent Number: 4,977,384

[45] Date of Patent: Dec. 11, 1990

[54] MICROPOLE UNDULATOR

[75] Inventors: Roman O. Tatchyn, Palo Alto, Calif.; Paul L. Csonka, Eugene, Oreg.; Jay T. Cremer, Burlingame, Calif.

[73] Assignee: The Board of Trustees of the Leland Stanford Junior University, Stanford, Calif.

[21] Appl. No.: 276,261

[22] Filed: Nov. 25, 1988

[51] Int. Cl.[5] ..... H01F 7/00

[52] U.S. Cl. ..... 335/210; 335/216; 505/1; 315/5.35

[58] Field of Search ..... 335/210, 216, 212, 214, 335/306; 315/5.35; 505/1

[56] References Cited

U.S. PATENT DOCUMENTS

| | | | |
|---|---|---|---|
| 4,647,887 | 3/1987 | Leupold | 335/306 |
| 4,720,692 | 1/1988 | Jin | 335/306 |
| 4,731,598 | 3/1988 | Clarke | 335/306 |
| 4,764,743 | 8/1988 | Leupold et al. | 335/212 |
| 4,829,276 | 5/1989 | Leupold et al. | 335/306 |

*Primary Examiner*—George Harris, Jr.

*Attorney, Agent, or Firm*—Klarquist, Sparkman, Campbell, Leigh & Whinston

[57] ABSTRACT

Micropole undulators for use in the generation of x-rays from moving charged particles are disclosed. Two rows of spaced apart poles are arranged so that each pole produces a magnetic field aligned with all other similar fields. The poles are the ends of "C"-shaped magnets. In each row, adjacent poles are separated by spacers made of a superconducting material.

33 Claims, 3 Drawing Sheets

MICROPOLE UNDULATOR

MICROPOLE UNDULATOR

This invention was made with government support under Grants No. DE-AC03-82-ER1300 and DE-FG06-85-ER13309, awarded by the Department of Energy and Grant No. AFOSR-85-0326 awarded by the Department of Defense. The government has certain rights in this invention.

SUMMARY OF THE INVENTION

The invention relates to undulators for generating electromagnetic radiation such as x-rays by passing charged particles, most particularly high energy electrons, through a series of magnetic fields which cause the particles to undulate transversely or "wiggle" as they travel along a substantially linear trajectory. In particular, the invention includes undulators for use in x-ray generating equipment suitable for medical diagnostic and research use.

Presently, undulators are used to generate electromagnetic radiation, particularly x-rays from particles travelling in linear accelerators, storage rings and other similar particle acceleration devices. Typically, such undulators comprise two series of bar magnets located on opposite sides of the path along which particles are accelerated. As particles pass between the series of bar magnets, they pass through a series of magnetic fields of alternating polarity. These fields cause the particles to be displaced transversely. As the particles are subjected to periodically-varying transverse motion, electromagnetic radiation is released.

An undulator's internal field profiles may be designed from a specification of the desired properties of the output radiation. Conversely, for trajectories of a known character, the properties of the associated output radiation can readily be computed. In particular, radiation from sinusoidal trajectories is well understood and has been extensively treated and/or tabulated by several authors, including Krinsky et al. in *Handbook on Synchrotron Radiation,* ed. E. E. Koch (Amsterdam, 1983). In consequence of this, undulators that induce sinusoidal trajectories, particularly those restricted to a plane, are in predominant use today. It is easy to deduce, from the Lorentz force acting on a relativistic charged particle moving along an undulator axis, that to achieve such a trajectory, a unidirectional field of sinusoidally varying amplitude must be set up perpendicular to the undulator's midplane. Most undulators are therefore constructed to approximate this requirement. The undulators described herein can, however, be constructed to produce fields of more general periodic or non-periodic distribution if so desired.

At present, magnetic-field undulators employ electromagnets, permanent magnets, and soft steel in various combinations. Common to most of these designs is the segmentation of the elements used to provide the field variations within the individual periods. In one design, described by K. Halbach in *Journal of Applied Physics,* 57, 8, IIA, 3605 (1985), four individual permanent magnets are placed serially in both the top and bottom "jaws" bordering one period of the device, with their fields rotated successively by 90°. Along the midplane between the jaws, this produces one period of an approximately sinusoidal magnetic field.

To provide highly monochromatized x-rays or high energy x-rays, in a laboratory such as that of a medical center or university, which would have only relatively low energy electrons available to it, one needs an undulator with very closely spaced poles.

The traditional technique for making such undulators is to mount a series of varyingly magnetized bars on a supporting substrate, typically using some form of adhesive. However, there is no practical way to mount very small bars, or more correctly "fibers", of magnetized material using such a technique. The spacing of the magnetized bars is critical, but there is no practical way to hold very small magnetized bars in close proximity to one another while the adhesive is being set. An adjacent pole will attract or repel the magnetized fiber being laid down. Even orienting such small bars, so that their poles are in proper alignment, leads to great difficulties. Moreover, appropriate magnetizable materials tend to be brittle and easily broken if small in size, particularly if subjected to the magnetic field of an adjacent magnetized bar.

Construction problems have been avoided by the techniques described in U.S. Pat. No. 4,800,353, issued Jan. 24, 1989, which is incorporated herein by reference.

But, it is also a problem that adjacent, closely spaced poles, whose magnetization vectors point in different directions, tend to reduce each other's field strength due to flux crossover. This flux crossover effect reduces the effectiveness of undulators having closely spaced poles.

It has now been discovered that undulators with small periods can be constructed without having to deal with the difficulties of mounting magnetized fibers. This is accomplished by forming laminates of sheet materials that are preferably not permanently magnetized, but which can later be magnetized by the application of an electric current.

Flux crossover at the boundaries of closely spaced poles is substantially eliminated by placing a layer of a superconducting material between the poles. By substantially eliminating flux crossover, it becomes possible to create fields in the undulator gap that are limited by the saturation field of the material comprising the laminate. Such fields for presently available materials can be more than twice as high as the highest fields available from permanent magnets.

Accordingly, it is an object of the present invention to provide undulators with short periods and high magnetic fields.

A further object is to provide short period undulators with high magnetic fields that are well controlled and have minimal flux crossover at pole boundaries.

These and other objects and advantages of the present invention will become apparent from reading the following detailed description with reference to the accompanying drawings.

DETAILED DESCRIPTION

A "micropole undulator", as discussed herein, is defined as an undulator having a period of less than one millimeter and correspondingly short poles.

A material with "large relative magnetic permeability" is a material that attracts and channels magnetic fields.

A material with "low relative magnetic permeability" is a material that responds weakly to the presence of magnetic fields.

Figure 1:
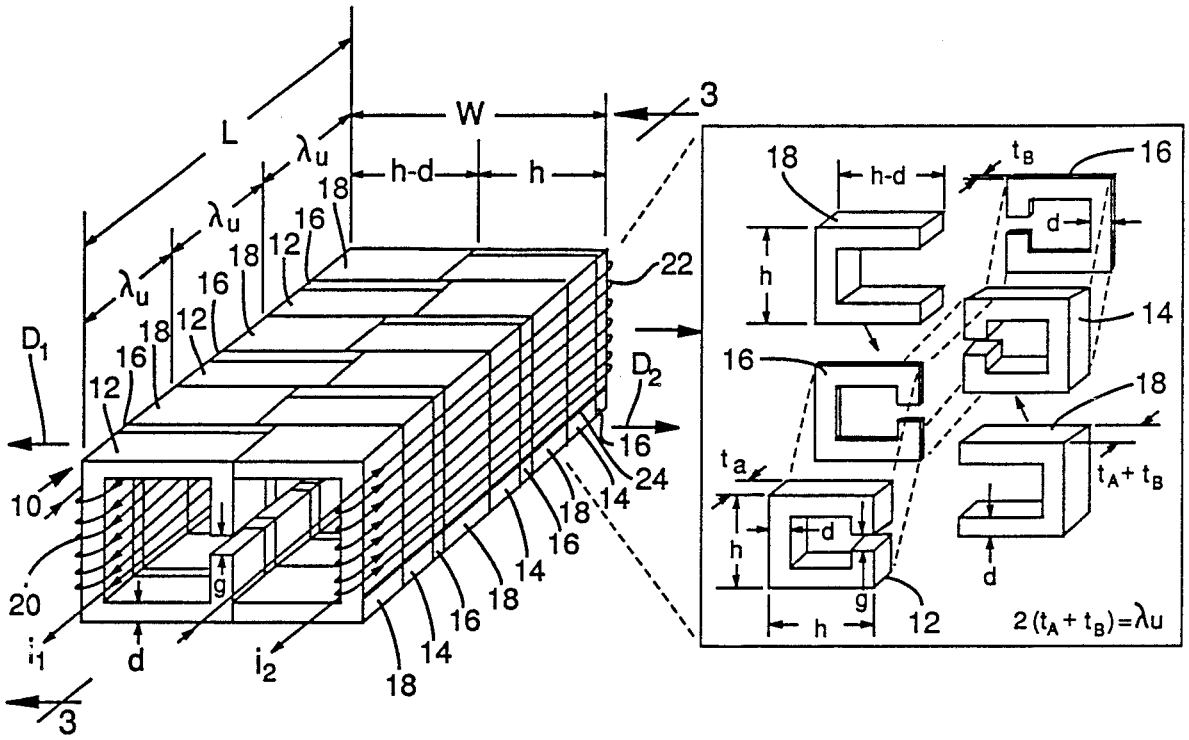
FIG. 1 is an isometric view of a micropole undulator according to the present invention, with an exploded view of a single period of the undulator.
Figure 2:
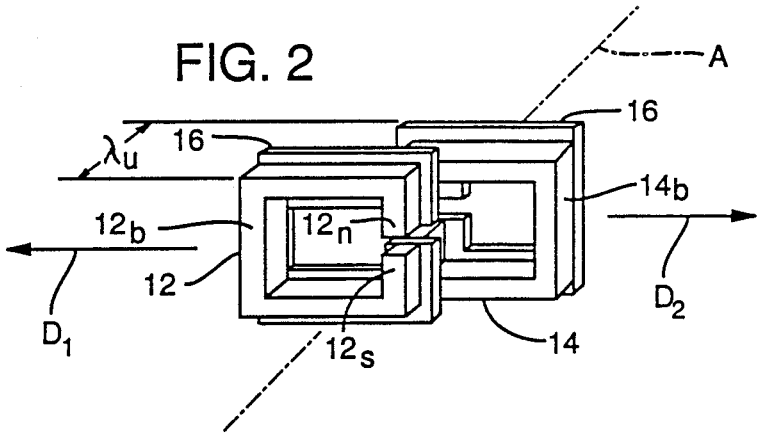
FIG. 2 is an isometric view showing magnets and superconducting spacers of a single period of the undulator of FIG. 1.
Figure 3:
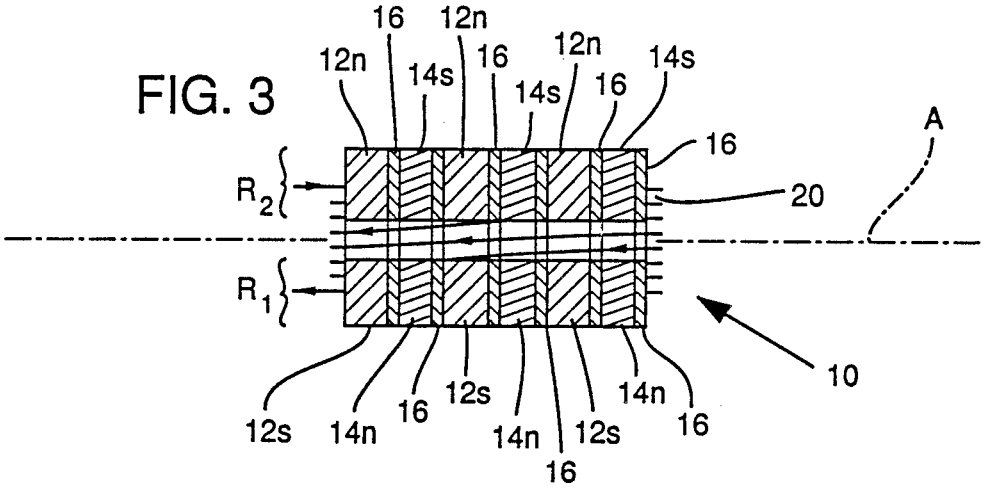
FIG. 3 is a sectional view taken along line 3—3 of FIG. 1.

The basic construction of an undulator according to the present invention is shown in FIGS. 1-3. As best seen in FIG. 3, the central part of the undulator 10 comprises two rows $R_1$, $R_2$ of magnetic elements 12, 14. Rows $R_1$, $R_2$ lie on either side of and an equal distance from an axis A which, in use, is positioned substantially to coincide with the trajectory of moving charged particles. Adjacent elements 12, 14 of each row are adapted to provide oppositely directed magnetic fields 15 extending across the axis A as shown schematically in FIG. 4.

The illustrated undulator is a laminate of multiple "C"-shaped magnets 12, 14 and spacers 16, 18 which are aligned side-to-side and generally extend transversely to the axis A so that the magnetic fields 15 created by the magnets cross the axis, preferably perpendicularly thereto. Each of the magnets 12, 14 has a north pole end $\mathbf{12}_n$ or $\mathbf{14}_n$ and a south pole end $\mathbf{12}_s$ or $\mathbf{14}_s$. In addition, each magnet also has a body portion $\mathbf{12}_b$ or $\mathbf{14}_b$ which extends between the ends.

In the laminate, each magnet has one of its poles located in a different row on opposite sides of the undulator axis A. Both poles of each magnet extend toward the axis A and parallel to each other. Preferably, the poles of each magnet are positioned directly opposite each other as illustrated, so that a magnetic field 15 extends across the axis, between opposed ends of each magnet. The magnets 12 are in a first orientation, and the magnets 14 are in a second orientation to provide the oppositely directed magnetic fields.

The spacers 16, which are provided between the magnetic elements 12, 14, are made of a superconducting material. The use of a superconducting material substantially prevents flux crossover at the boundaries of magnetic elements 12, 14. A variety of superconducting materials can be used to make the spacers 16 of the illustrated undulator. The superconducting material used to make the spacers 16 is preferably either $Tl_2Ca_1Ba_2Cu_2O_{8+\delta}$ or $Tl_2Ca_2Ba_2Cu_3O_{10+\delta}$ as described in Hazen, et al., "Hundred °K Superconducting Phases in the Thallium, Calcium, Barium, Copper, Oxygen, System," *Physical Review Letters*, 60,1657 (1988). Other superconducting materials with other critical temperatures are well known and have been described in the literature. For example, niobium could be used as described in the *Handbook of Mathematical, Scientific, and Engineering Formulas, Tables, Functions, Graphs, Transforms*, (M. Fogiel, ed.), Research and Education Association, New York. The superconducting spacers 16 are "C"-shaped in the embodiment of FIGS. 1-2. These spacers 16 also can be made "oversized" as shown in FIG. 2.

Figure 5:
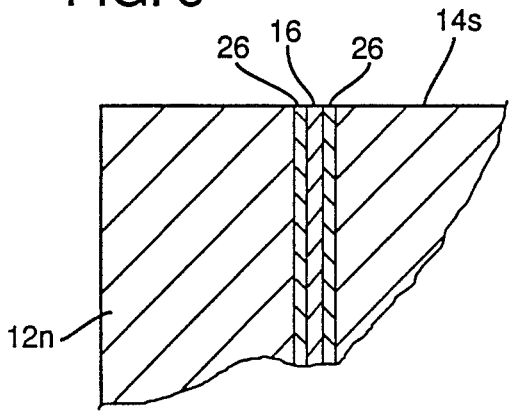
FIGS. 5-7 are enlarged partial views of FIG. 3, showing additional detail.
Figure 6:
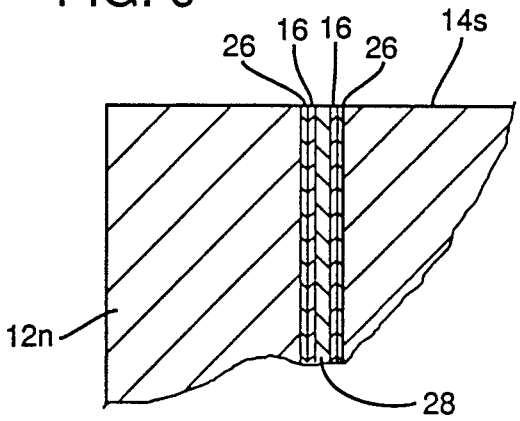
Figure 7:
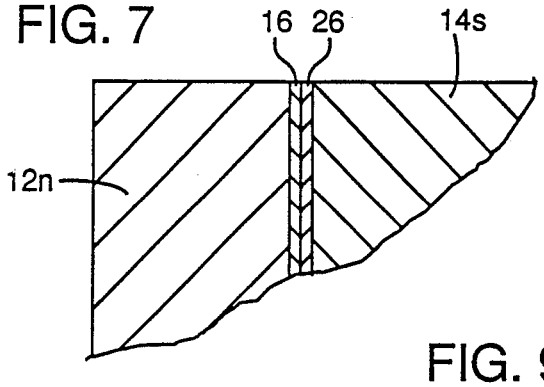

There are a variety of ways in which the spacers 16 can be incorporated into the laminate. The simplest method, for superconducting materials that are structurally strong, is to make a separate sheet of the material cut to the desired shape. Alternative constructions, particularly useful with brittle superconducting materials, are shown in FIGS. 5-7, which are enlargements of the upper left corner of FIG. 3. In FIG. 5, the sheet 16 of superconducting material is sandwiched between two layers 26 of a structurally strong dielectric material, such as MYLAR sheeting, for added support. In the embodiment of FIG. 6, two layers 16 of superconducting material are sputtered onto a substrate 28 made of a material of low relative magnetic permeability, such as copper, with outer dielectric layers 26 provided to protect the superconductive material. FIG. 7 shows a layer 16 of superconductive material that has been sputtered directly onto one of the magnets 12 and protected by a dielectric sheet 26. It will be apparent that the dielectric material can be cut to any desired shape to protect all or part of one or both sides of a superconducting layer.

Because the spacers 16 are widely spaced from each other, the magnets 12, 14 would normally be at independent magnetostatic potentials. It is possible to establish a common potential, however, by joining the superconducting spacers 16 with a wire or strip 24 of superconducting material. Preferably, the wire 24 extends axially and is in contact with each spacer 16 in a given series.

Figure 8:
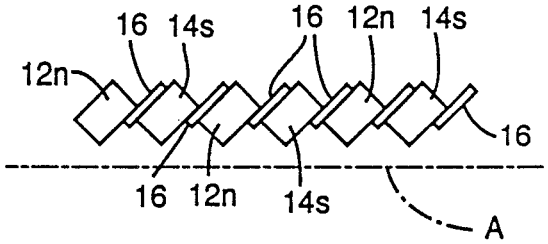
FIG. 8 is a partial sectional view showing a row of magnetic elements in slanted orientation.

The magnets 12, 14 need not be aligned perpendicularly to the axis A, and in some instances are best not so aligned. FIG. 8 shows a row of magnetic elements that are similar to those in $R_1$ of FIG. 3, but are tilted and do not present a smooth surface along the axis A. This orientation will give better pole isolation in certain circumstances.

The bodies $\mathbf{12}_b$ or $\mathbf{14}_b$ of adjacent magnets and associated spacers 16 are separated by "C"-shaped spacers 18 which provide structural support. The spacers 18 are preferably made of a material having a low relative magnetic permeability, such as brass or copper.

Figure 9:
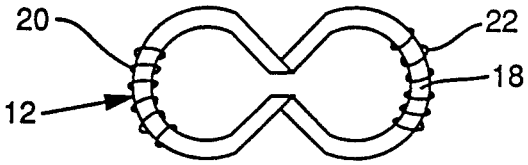
FIG. 9 is a schematic, elevational front view of a micropole undulator having magnets of an alternative shape.

The term "C"-shaped as used herein is intended to refer to any structure that is the equivalent to an open ring with ends conveniently located to serve as poles along an undulator axis. For example, the structure shown in FIG. 9, although different in appearance to those in other figures, may be preferable. In this embodiment, there is little overlap of the magnets of the two series. And, because the bodies of the magnets 12, 14 are more widely separated, the extent of field interference should be reduced.

The laminate may be held together by any of several techniques. Advantageously, the magnets 12, 14 and spacers 16, 18 are stacked in a rack or frame (not shown) with a mechanism for axially compressing the laminate to hold the elements in place. Alternatively, the elements could be held together with adhesive, but this is less preferred since it is difficult to install replacement parts.

In the illustrated undulator, magnets 12 in the first orientation extend away from the axis in a direction D1, while magnets 14 of the second orientation extend away from the axis in a direction D2 that is opposite D1. As a result, there is a first series of magnets consisting of the magnets 12 in the first orientation and a second series of magnets consisting of the magnets 14 in the second orientation.

This arrangement facilitates the use of electromagnets instead of permanent magnets which would be harder to laminate and which would decrease in magnetization with prolonged exposure to radiation. Electromagnets are formed by providing a first set of windings 20 around the bodies $\mathbf{12}_b$ of the magnets 12 of the first series, and a second set of windings 22 around the bodies $\mathbf{14}_b$ of the magnets 14 of the second series. The bodies are made of a material with a large relative magnetic permeability, preferably a ferromagnetic material such as iron or steel.

The illustrated undulators have submillimeter periods with "C"-shaped magnets that are substantially square in transverse cross-section. The dimensions of these elements can be varied by routine experimentation to achieve a variety of goals. In the illustrated embodiment:

$h=3$ in.

$d=3/8$ in.

$t_A=250$ microns $t_B=125$ microns

Figure 4:
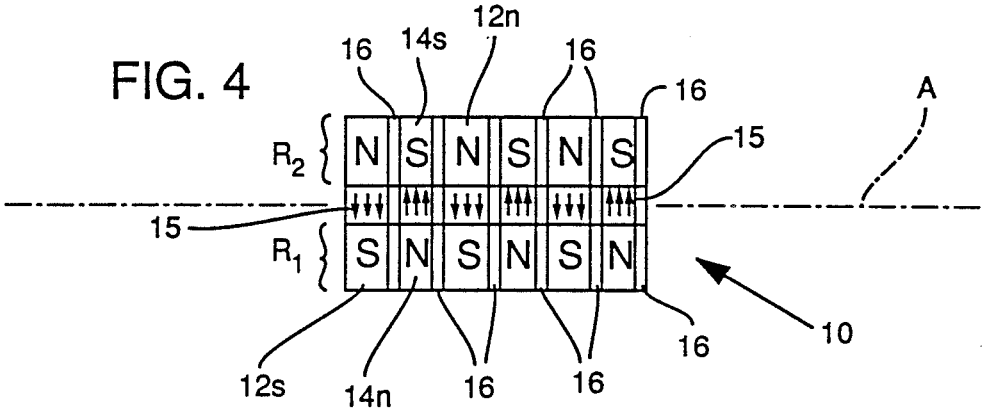
FIG. 4 is a schematic, sectional view taken along line 3—3 of FIG. 1, showing magnetic field lines.

In operation, a current source (not shown) is connected to the windings so that, as current flows along the windings, the magnetic fields 15 of FIG. 4 are formed. In particular, flux is generated in the two series of magnets 12, 14, by the windings carrying currents $i_1$, $i_2$, respectively. Due to the indicated different directions of current flow, the fields in the gaps of the magnets 12 and magnets 14 are directed in opposite senses, establishing a midplane undulator field of zero average value in each period of the device. The undulator is positioned so that charged particles move along the axis A between and substantially parallel to the rows $R_1$, $R_2$. As a result, the particles undulate as they pass through the alternating magnetic fields 15.

Figure 10:
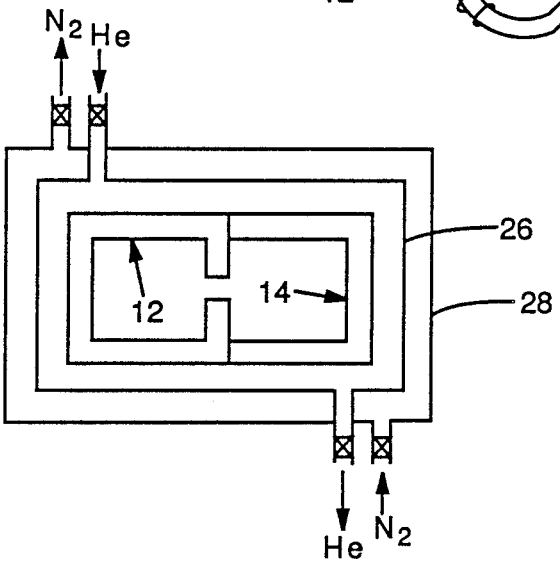
FIG. 10 is a schematic, sectional view of a micropole undulator with surrounding cooling jackets.

To maintain the superconducting nature of the spacers 16 during operation, the undulator is cooled during use to a temperature of 110° K. This can be accomplished by surrounding the undulator with a body of liquid helium contained in a cooling jacket 26, as shown in FIG. 10. An outer jacket 28 contains a body of liquid nitrogen which serves as buffer between the liquid helium and the ambient atmosphere.

Figure 11:
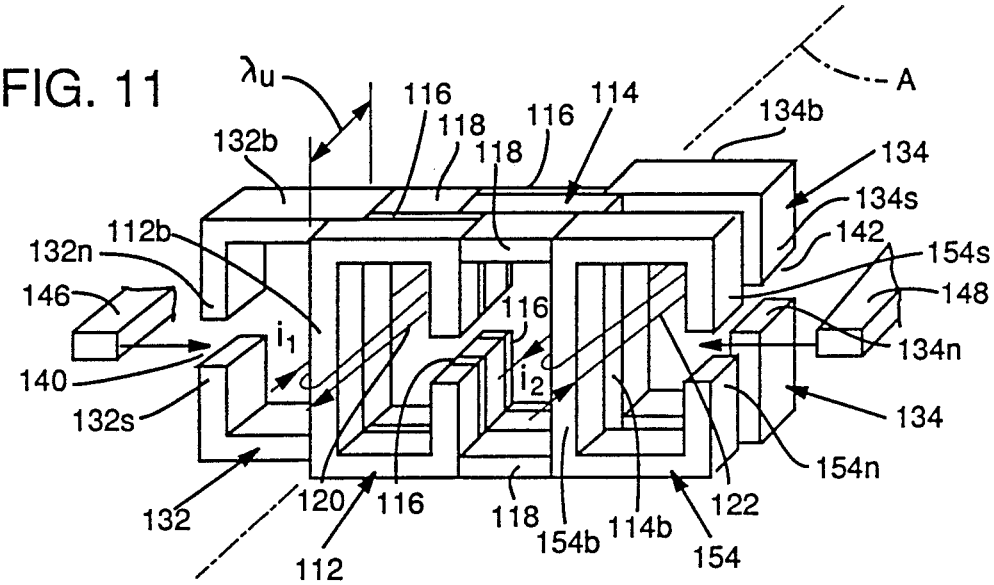
FIG. 11 is an isometric view of a second embodiment of a micropole undulator according to the present invention.

Another embodiment of the undulator is shown in FIG. 11, wherein corresponding features are numbered as in FIGS. 1–4, with the reference numerals incremented by 100.

In the embodiment of FIG. 11, the spacers 116 are "L"-shaped bars and the spacers 118 are straight bars, rather than "C"-shaped. Additional structural support between adjacent magnet bodies $\mathbf{112}_b$ and adjacent magnet bodies $\mathbf{114}_b$ are provided by "C"-shaped cores 132, 134, respectively. The cores 132, 134 have a large relative magnetic permeability and are preferably made of a ferromagnetic material such as iron or steel. Each core 132, 134 has first and second ends $\mathbf{132}_n$, $\mathbf{32}_s$ or $\mathbf{134}_n$, $\mathbf{134}_s$, and a body $\mathbf{132}_b$ or $\mathbf{134}_b$ that extends between the ends. The bodies of the cores 132, 134 are located between the bodies of the magnets 112, 114. A right front-most core 154 and a left rear-most core (not shown) are identical in function to the cores 134, 132, respectively, but are thinner by the thickness of spacers 116, in order to provide smooth, flat surfaces on both the front and the rear of the undulator structure. The ends $\mathbf{132}_n$, $\mathbf{132}_s$ and $\mathbf{134}_n$, $\mathbf{134}_s$ of each core define a gap 140, 142. The gaps 140 of the cores 132 which are located between the magnets 112 of the first series are in alignment to form a first keyway, and the gaps 142 of the cores 134 which are located between the magnets 114 of the second series are in alignment to form a second keyway. First and second bars 146, 148 of a material with a large relative magnetic permeability can be guided into the keyways. This arrangement allows for mechanical fine-adjustment of the gap flux in the central undulator gap along axis A. The bars 146, 148 preferably are made of a ferromagnetic material such as iron or steel.

Whereas the magnets 12, 14 would be at independent magnetostatic potentials in the embodiment of FIG. 1 if the superconducting spacers 16 were not linked by the wire 24, magnets 112 and 114 of FIG. 11 are at a common potential due to the contiguity of the cores and magnets on either side of the undulator. Otherwise, except for adjustments made by moving the bars 146, 148, the undulator of FIG. 11 operates identically to that of FIGS. 1–4.

Having illustrated and described the principles of our invention with reference to preferred embodiments, it should be apparent to those persons skilled in the art that such invention may be modified in arrangement and detail without departing from such principles. For example, an undulator could have but a single row of magnetic elements with the row extending alongside and parallel to the undulator axis; but, the use of two rows is preferred to provide stronger and straighter magnetic fields across the axis. Accordingly, we claim as our invention all such modifications as come within the true spirit and scope of the following claims.

We claim:

1. An undulator for causing transverse undulations in the trajectory of a charged particle travelling along in a substantially linear trajectory that is in close proximity to the undulator core surface, the undulator comprising:

a row of magnetic elements extending alongside and parallel to an undulator axis which is positionable substantially to coincide with the trajectory of moving charged particles, alternate elements of the row being adapted to provide oppositely directed magnetic fields extending across the axis; and a plurality of spacers which are located between the magnetic elements and are made of a superconducting material.

2. The undulator of claim 1 wherein the spacers extend transversely to the axis.

3. The undulator of claim 1 wherein the magnetic fields extend substantially perpendicularly to the axis.

4. The undulator of claim 1 wherein:

the undulator comprises two opposed rows of the magnetic elements, the rows being located on opposite sides of the undulator axis;

the magnetic elements are provided by a plurality of magnets, each of which has a north pole and a south pole which are located in different rows on opposite sides of the undulator axis, both poles extending toward the axis and parallel to each other so that the magnetic fields extend across the axis; and the magnets are arranged in a row and alternately in first and second orientations to provide the oppositely directed magnetic fields.

5. The undulator of claim 4 wherein each magnet is generally "C"-shaped having:

a north pole end;

a south pole end; and a body that extends between the ends.

6. The undulator of claim 4 wherein the bodies of magnets in the first orientation extend away from the axis in a first direction and the bodies of magnets in the second orientation extend away from the axis in a second direction that is different from the first direction such that there is a first series of magnets consisting of the magnets in the first orientation and a second series of the magnets consisting of magnets in the second orientation.

7. The undulator of claim 6 wherein the bodies of adjacent magnets of the same orientation are separated by spacers of low relative magnetic permeability.

8. The undulator of claim 7 wherein the superconducting spacers also extend alongside the spacers of low relative magnetic permeability.

9. The undulator of claim 6 wherein the first and second directions are substantially opposite to each other and substantially perpendicular to the axis.

10. The undulator of claim 6 wherein the magnets comprise bodies of a material with a large relative magnetic permeability, the undulator further comprising:

a first set of windings around the bodies of the magnets of the first series;

a second set of windings around the bodies of the second series; and a current source to cause electrical current to pass along the windings of each set and thereby create the magnetic fields.

11. The undulator of claim 6 further comprising:

a plurality of generally "C"-shaped cores having a large relative magnetic permeability, each core having first and second ends and a body that extends between the ends, the bodies of the cores being located between the bodies of the magnets, the contiguity of the cores and the magnets on either side of the undulator enforcing a common magnetostatic potential, the ends of each core defining a gap, the gaps of those cores which are located between the magnets of the first series being in alignment to form a first keyway and the gaps of those cores which are located between the magnets of the second series being in alignment to form a second keyway; and first and second bars of a material having a large relative magnetic permeability, the bars being shaped to be received by the first and second keyways, respectively.

12. The undulator of claim 11 wherein:

the bodies of the magnets comprise a material having a large relative magnetic permeability;

a first set of windings extends around the bodies of the magnets and of the cores of the first series;

a second set of windings extends around the bodies of the magnets and of the cores of the second series; and a current source is provided to cause electrical current to pass along the windings of each set and thereby create the magnetic fields.

13. The undulator of claim 5 wherein:

the bodies are made of a material that has a low magnetic remanence; and magnetization of the magnets is induced with an electric current.

14. The undulator of claim 5 wherein the bodies are made of a ferromagnetic material selected from the group consisting of iron and steel.

15. The undulator of claim 5 wherein the magnet bodies comprise permanent magnets.

16. A method for causing transverse undulations in the trajectory of a charged particle travelling along a substantially linear trajectory, the method comprising:

providing a row of magnetic elements of alternating polarity such that a series of alternately directed magnetic fields is located alongside the row, the magnetic elements being separated by spacers made of a superconducting material; and directing moving charged particles along a trajectory that extends through the series of magnetic fields and is substantially parallel to the row.

17. The method of claim 16 wherein a pair of parallel rows of magnetic elements is provided such that the magnetic fields extend between the rows and the magnetic elements are provided by a plurality of magnets arranged in a row to provide the oppositely directed magnetic fields, each magnet comprising:

a north pole end located in one of the rows;

a south pole end located in the other row, the south pole end extending parallel to the north pole end so that the magnetic fields extend across the axis; and a "C"-shaped body that extends between the ends.

18. The method of claim 17 wherein:

the bodies comprise a material that has a low magnetic remanence; and magnetization of the bodies is induced with an electric current.

19. The method of claim 17 wherein the bodies comprise permanent magnets.

20. An undulator for causing transverse undulations in the trajectory of a charged particle travelling along a substantially linear trajectory that is in close proximity to the undulator core surface, the undulator comprising a plurality of magnets wherein:

each magnet has a north pole and a south pole which are located on opposite sides of an undulator axis, which axis is positionable substantially to coincide with the trajectory of moving charged particles, both poles extending toward the axis and parallel to each other; and the magnets are arranged in a row and alternately in first and second orientations to provide an alternating series of oppositely directed magnetic fields that extend across the axis and substantially parallel to each other.

21. The undulator of claim 20 wherein the north and south poles of each magnet are positioned directly opposite each other.

22. The undulator of claim 20 wherein each magnet is generally "C"-shaped having:

a north pole end;

a south pole end; and a body that extends between the ends.

23. The undulator of claim 22 wherein the bodies of magnets in the first orientation extend away from the axis in a first direction and the bodies of magnets in the second orientation extend away from the axis in a second direction that is different from the first direction such that there is a first series of magnets consisting of the magnets in the first orientation and a second series of the magnets consisting of magnets in the second orientation.

24. The undulator of claim 23 wherein the bodies of adjacent magnets of the same orientation are separated by spacers of low relative magnetic permeability.

25. The undulator of claim 24 wherein the poles of adjacent magnets of opposing fields are also separated by superconducting spacers.

26. The undulator of claim 23 wherein the first and second directions are substantially opposite to each other and substantially perpendicular to the axis.

27. The undulator of claim 23 wherein the magnets comprise bodies of a material with a large relative magnetic permeability, the undulator further comprising:

a first set of windings around the bodies of the magnets of the first series;

a second set of windings around the bodies of the second series; and a current source to cause electrical current to pass along the windings of each set and thereby create the magnetic fields.

28. The undulator of claim 23 further comprising:

a plurality of generally "C"-shaped cores having a large relative magnetic permeability, each core having first and second ends and a body that extends between the ends, the bodies of the cores being located between the bodies of the magnets, the contiguity of the cores and the magnets on either side of the undulator enforcing a common magnetostatic potential, the ends of each core defining a gap, the gaps of those cores which are located between the magnets of the first series being in alignment to form a first keyway and the gaps of those cores which are located between the magnets of the second series being in alignment to form a second keyway; and first and second bars of a material having a large relative magnetic permeability, the bars being shaped to be received by the first and second keyways, respectively.

29. The undulator of claim 28 wherein:

the bodies of the magnets comprise a material having a large relative magnetic permeability;

a first set of windings extends around the bodies of the magnets and of the cores of the first series;

a second set of windings extends around the bodies of the magnets and of the cores of the second series; and a current source is provided to cause electrical current to pass along the windings of each set and thereby create the magnetic fields.

30. The undulator of claim 20 wherein the poles of adjacent magnets in each row are separated by superconducting spacers.

31. The undulator of claim 5 wherein:

the bodies are made of a magnetic material that has a low magnetic remanence; and magnetization of the magnets is induced by subjecting the bodies to the field of a permanent magnet.

32. The undulator of claim 6 wherein:

the bodies are made of a magnetic material that has a low magnetic remanence; and magnetization of the magnets is induced by subjecting the bodies to the field of a permanent magnet.

33. The method of claim 17 wherein:

the bodies comprise a material that has a low magnetic remanence; and magnetization of the bodies is induced by subjecting the bodies to the field of a permanent magnet.

* * * * *